US005127810A

United States Patent [19]

Kolbinger

[11] Patent Number: 5,127,810

[45] Date of Patent: Jul. 7, 1992

[54] ROTARY PUMP OR ENGINE WITH SPHERICAL BODY

[76] Inventor: Herman J. Kolbinger, 690 S. Main St., New City, N.Y. 10596

[21] Appl. No.: 636,910

[22] Filed: Jan. 2, 1991

[51] Int. Cl.[5] ..... F04C 3/06; F01C 3/06

[52] U.S. Cl. ..... 418/68; 418/165; 418/161

[58] Field of Search ..... 418/68, 160, 161, 165, 418/143, 144, 112

[56] References Cited

U.S. PATENT DOCUMENTS

| | | | |
|---|---|---|---|
| 1,890,612 | 12/1932 | Kempthorne | 418/68 |
| 3,545,899 | 12/1970 | Clarke | 418/68 |
| 3,815,362 | 6/1974 | Kolbinger | 60/525 |
| 3,816,038 | 6/1974 | Berry | 418/68 |
| 3,816,039 | 6/1974 | Berry | 418/68 |
| 4,519,756 | 5/1985 | Fenton | 418/68 |
| 4,631,011 | 12/1986 | Whitfield | 418/68 |

FOREIGN PATENT DOCUMENTS

| | | | |
|---|---|---|---|
| 56-9690 | 1/1981 | Japan | 418/68 |
| 56-9691 | 1/1981 | Japan | 418/68 |
| 821747 | 4/1981 | U.S.S.R. | 418/68 |

*Primary Examiner*—Richard A. Bertsch
*Assistant Examiner*—David L. Cavanaugh

[57] ABSTRACT

There is disclosed a rotary pump or engine or compressor or expander comprising a spherical cavity divided by a pivotable disc into two sections. First and second wedges are pivotally connected at opposed disc surfaces. One wedge may be driven causing the disc to pivot and rotate the second wedge covering and uncovering suitably positioned inlet and outlet ports for transferring fluid. Novel constructions to simplify manufacturing and improve sealing are described.

18 Claims, 8 Drawing Sheets 113
160'
160'
190
112
190
190

113
160'
160'

112
190

190
191'
191

295
212
290
A
A
290
295

294
290
294
290
A
A
212
294

295
294
293
292
290
292
294
293
212
295

ROTARY PUMP OR ENGINE WITH SPHERICAL BODY

This application relates to pumps or engines employing a spherical geometry of the type described in my earlier issued U.S. Pat. No. 3,815,362.

BACKGROUND OF INVENTION

In my prior U.S. Pat. No. 3,815,362, the contents of which are hereby incorporated by reference, I describe a rotary engine providing two cooperating Stirling cycle systems, which comprises a spherical cavity divided by a pivotable disc into two hemispherical sections, a heated or hot section and a cold section, interconnected by an external conduit. The hot section is divided by a partition into two chambers. A spherical wedge is rotatably mounted in the cold section and is drivingly connected to a crank shaft. Expanding fluids alternating in the heated section cause the disc to pivot and the wedge to rotate and pivot causing rotation of the crank shaft.

SUMMARY OF INVENTION

The present invention is directed to modified positive displacement device constructions employing the spherical cavity, pivoting disc, and cooperating wedge features novelly arranged to obtain a pump or compressor or an improved engine.

In accordance with a first embodiment of the invention, two wedges are provided pivotally mounted at opposite disc surfaces in such a manner that their pivotal axes intersect the disc center and are orthogonal to one another. The wedges and discs have a circular periphery shaped to rotate within and about the center of the spherical cavity of a fixed housing. The periphery of a first wedge, the driving wedge, is connected to a drive shaft journalled in the cavity housing on one side of the disc and the periphery of the second wedge, the driven wedge, is journalled in the cavity housing on the opposite side of the disc. Inlet or intake, and outlet or exhaust ports are provided in the housing wall in locations to be covered and uncovered as each wedge rotates. When the driving wedge is rotated, the disc follows an eccentric path within the spherical cavity causing rotation of the driven wedge and in cooperation with the wedges transferring fluid from inlet to outlet. The angle between the axes of rotation of the wedges controls the displacement of the disc and thus the output.

In accordance with a second embodiment of the invention, the housing providing the spherical cavity is journalled for rotation about hollow shafts. The two wedges, as in the first embodiment, are pivotally mounted at opposite surfaces of the disc along orthogonal axes. In this second embodiment, the driving wedge is anchored to the housing and rotates therewith. The disc is pivotally mounted on the housing and also rotates therewith. The driven wedge is journalled on an offset member fixed to a hollow shaft. Suitable inlet and outlet ports are provided for cooperation with each of the wedges. In this second embodiment, when the housing is rotated, the driving wedge only rotates as in the first embodiment, but the driven wedge both rotates and pivots.

There are additional features associated with these embodiments. As one feature, the shaft journals and the inlet and outlet parts can be located in one half of the spherical body, which has certain manufacturing and sealing advantages.

As another feature, the coupling of a wedge to the disc is at a straight sealing area, which again offers sealing advantages.

As a further feature, the ports can be located in the wedges rather than in the body.

As still another feature, the spherical body can be given a special construction reducing leakage in high-pressure applications.

A further feature is to locate the parts so that incoming fluid containing an oil mist can provide continuous lubrication of the wedge/disc journal.

Another feature is a novel disc construction with improved seals to the spherical body.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described the preferred embodiments of the invention.

DETAILED DESCRIPTION OF PREFERRED EMBODIMENTS

Figure 1:
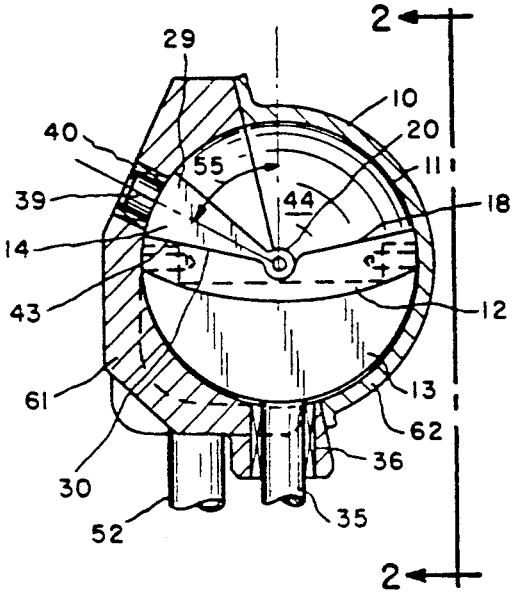
FIG. 1 is a plan view of a first embodiment in accordance with the invention, with the housing sectioned along the center, along the line 1—1 of FIG. 3.

Referring now to the drawing, FIGS. 1–4 show one embodiment of my pump in accordance with the invention. The pump, in this first embodiment, comprises a fixed housing 10 containing an interior cavity 11 shaped to form the major portion of a sphere. Housed within the cavity 11 are the three principal moving parts of the pump, comprising a disc 12, a first driving wedge 13 and a second driven wedge 14.

The disc 12, whose diameter is slightly less than the diameter of the spherical cavity 11, has a peripheral surface substantially matching that of the cavity in order to allow the disc to rotate or pivot within the cavity. Suitable seals, not shown, may if desired be embedded in the disc rim 16 to ensure adequate sealing to the cavity interior. Each side 17, 18 of the disc 12 has a radial concavity and a semi-cylindrical convex portion 19, 20 along a diameter thereof. Each convex portion 19, 20 is located in the disc radial concavity, which as will be observed, curve in orthogonal planes, with the result that the convex portions are also orthogonal. This construction allows the axes of the convex portions 19, 20 to extend in the same plane orthogonal to one another and to intersect one another at the disc center, which coincides with the sphere center. Thus the wedges can pivot about orthogonal axes that intersects at the disc center, which is also the center of the cavity 11.

Each of the wedges 13, 14 may have a similar shape. Their outer periphery 25, 26 is shaped as a sphere section to mate with and ride on the interior surface of the spherical cavity. As in the case of the disc, suitable seals, not shown, can if desired be embedded in these surfaces 25, 26 to provide adequate sealing to the cavity. The remaining wedge surface at the wedge apex is provided with spaced cylindrical projections 27, 28 adapted to mate at opposite sides with the convex portions 19, 20 of the disc 12. The remaining faces 29, 30 of the wedges may be flat and include an angle between them of generally 90° or less. A preferred angle is about 15°.

The disc 12 and wedges 13, 14 are interconnected by fitting the wedge projections 27, 28 over the ends of the disc convex portions 19, 20 and inserting a short pin 31 at each end to pin them together. Suitable seals are provided, not shown, at this interconnection if desired to restrict fluid leakage as the disc 12 pivots during operation about the axes of the pin connections.

A drive shaft 35 for the pump is journalled 36 in the housing wall. The drive shaft 35 is fixedly secured 37 to the center of the spherical surface 25 of the driving wedge 13. When the shaft 35 is rotated by a suitable motor (not shown), the driving wedge 13 also rotates about the shaft axis. The center of the spherical surface 26 of the driven wedge 14 is secured to a short rod 39 journalled 40 in the housing wall. The driven wedge 14 rotates about the rod 39 axis.

The disc 12 divides the cavity 11 into two sections, each of which is divided by their associated wedge into two chambers 41, 42 and 43, 44. Each section has an inlet port 45, 46 and outlet port 47, 48. A first external conduit 50 interconnects the two inlet ports 45, 46 to form a common inlet 52, and a second external conduit 51 interconnects the two outlet ports 47, 48 to form a common outlet 53.

Operation of this first embodiment is as follows. The disc, as mentioned, divides the cavity into two fluid-tight halves or sections, each housing one of the wedges. Each wedge in turn divides its section into two chambers, thus totalling four chambers that can be cycled at 90° to each other. This can be seen as follows. FIG. 1 shows the driving wedge 13 occupying a mid-position defining equal-sized chambers 41 and 42 (see FIG. 2). The driven wedge 14 occupies a closed position lying close to the disc defining a small sized chamber 43 (volume close to zero) and a large sized chamber 44. In one-quarter cycle (90° rotation of driving wedge 13), the driving wedge 13 will be close to the disc, contracting chamber 41 volume close to zero and expanding chamber 42 to its maximum volume, while the driven wedge 14 will have moved to its midposition, making chambers 43, 44 of equal size. At the one-half cycle position (driving wedge rotated 180°), the geometry of FIG. 1 will look the same, except that the opposite wedge surface 29 of driven wedge 14 will be close to the facing disc surface, contracting chamber 44 volume to zero and expanding chamber 43 to its maximum value, and the driving wedge 13 is at its midposition. The three-quarter cycle position corresponds to the one-quarter cycle position except that chambers 43 and 44 are equal sized, and chamber 41 volume is maximum and chamber 42 volume is minimum. The four-quarter cycle position (full 360° rotation of driving wedge 13) corresponds to the parts position illustrated in FIG. 1.

Figure 2:
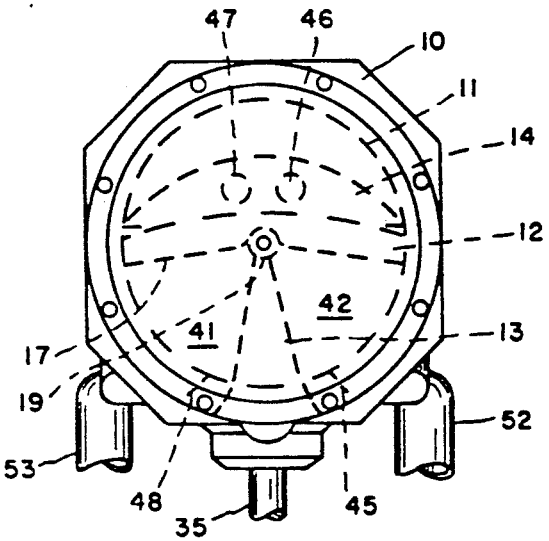
FIG. 2 is a side view of the first embodiment of FIG. 1, taken from the right side of FIG. 1.
Figure 3:
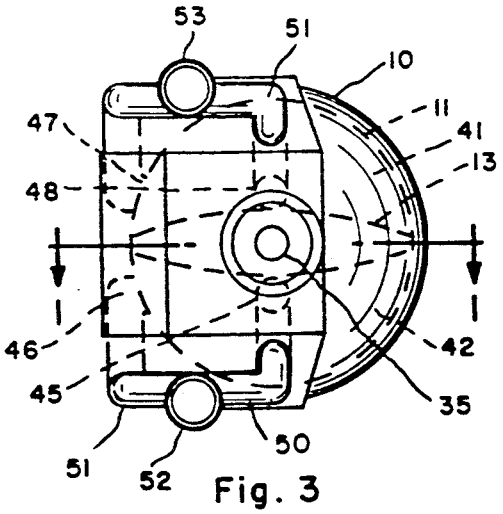
FIG. 3 is a bottom view of the first embodiment for FIG. 1, also taken from the bottom side of FIG. 2.
Figure 4A:
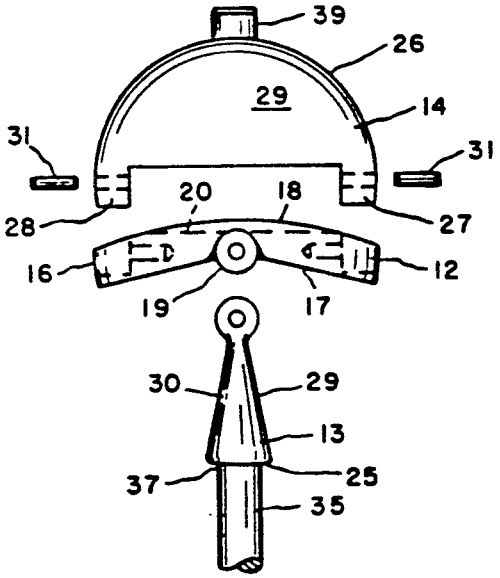
FIGS. 4*a* and 4*b* are, respectively, an exploded view and an assembled view of the disc and two wedges showing one form of suitable interconnection.
Figure 4B:
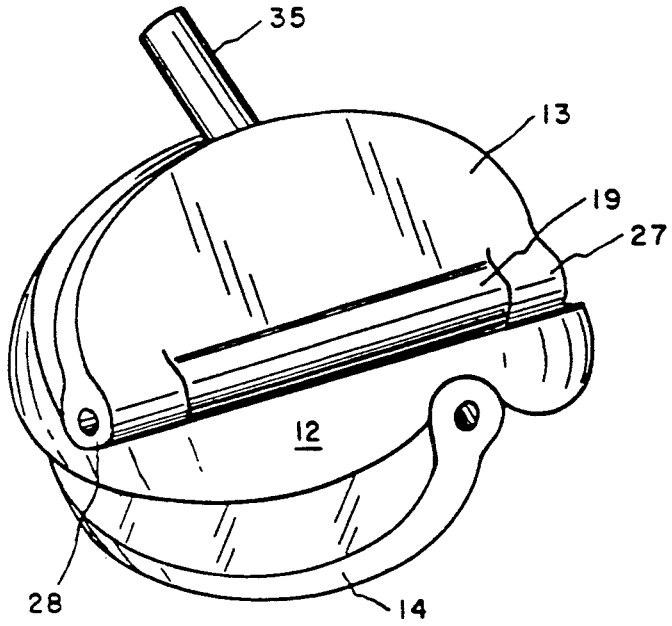

The driving wedge performs two functions. First, it functions to cover and uncover the inlet 45 and exhaust 47 ports in its cavity half to accomplish fluid intake and exhaust. Second, it drives the disc. The disc 12 performs three functions. First, its eccentric rotation in cooperation with the driving wedge 13 causes expansion of one chamber 41 while the inlet port 45 is uncovered to draw fluid into it, while fluid in the second chamber 42 is impelled out the outlet 47 as the volume of the latter contacts, the fluid then transferring to the second chamber as the disc continues its rotation. Second, it drives the driven wedge 14. Third, its cooperates with the driven wedge 14 in the second section similarly to that with the driving wedge to draw fluid into one chamber 43 of the second section through its inlet port 46 and transfer fluid via the adjacent chamber 44 through its outlet port 48 as the disc rotates. The angle of the axes of rotation of the two wedges, designated 55 in FIG. 1, controls the displacement of the disc and the pump output. Thus if the axes were aligned, zero output would be obtained. As the angle 55 increases, increased disc displacement results and increased pump output. FIG. 1 illustrates a construction offering maximum displacement. As will be clear from the foregoing, the inlet and outlet ports are located in such manner on the cavity walls, and the wedge is dimensioned such that the inlet port is uncovered for the required time during the intake cycle to fill the first chamber with fluid, both ports remain partly covered during fluid transfer to the second chamber, and the outlet port is uncovered for the required time to displace the fluid out the outlet during the exhaust part of the cycle. As one example, which is not to be considered limiting, for a spherical cavity with an I.D. of about four inches, and with the ports located as illustrated in FIGS. 1-3 and with a typical port size of about one-half inches, a typical wedge angle would be about 15 degrees. In this embodiment, both inlet and outlet ports remain covered during only a small fraction of the cycle, and remain uncovered at least in part during the remainder of the cycle, so that fluid can be drawn in during expansion of the input chamber and fluid exhausted during contraction of the output chamber. The eccentric disc motion is similar to that described in U.S. Pat. No. 3,815,362, to which reference is made for a clearer understanding.

The pump in accordance with my invention offers the following advantages. Only three moving parts are required, reducing cost and simplifying repair. It offers large positive displacement enabling high volume output in compact pump sizes, and for large sizes relatively low weight. It will also operate at low noise levels. Adequate sealing of the mating surfaces with conventional seals can be easily obtained, due to the simple spherical geometry. In addition, the spherical geometry lends itself to the use of gap sealing with a suitable lubricant.

Figure 5A:
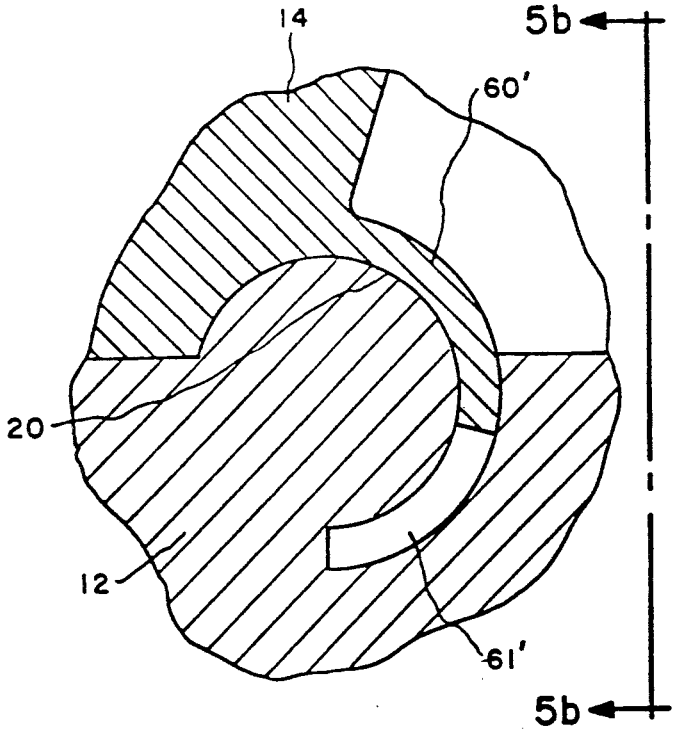
FIGS. 5*a* and 5*b* are, respectively, a partly sectional and side view of a modified wedge showing another form of suitable interconnection to the disc.
Figure 5B:
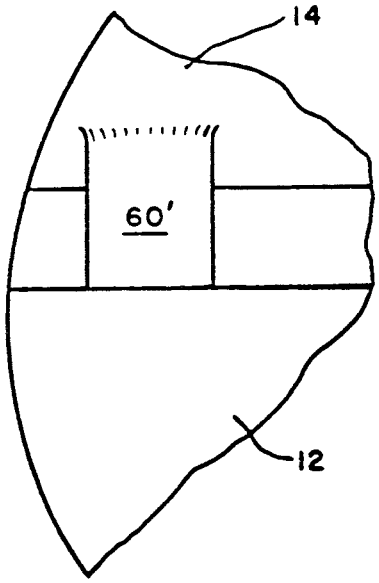

FIG. 5 is a perspective view of a modified form of mounting of the wedges on the disc. The wedge cylindrical projections are replaced by a pair of curved hook members 60 whose axis of symmetry coincides with that of the projections of the other embodiment. The hook members 60' are shaped to engage similarly shaped recessed portions 61' located at the disc convex portions and whose axes of symmetry coincide with convex portions. The pins 31 may be omitted since the cavity walls keep the wedges from separating from the disc.

To assemble the pump of FIGS. 1-3, as illustrated in FIG. 1, the housing 10 is constructed in two halves 61, 62 which may be suitably fastened together along mating flanges as shown, by for example screws.

Figure 6:
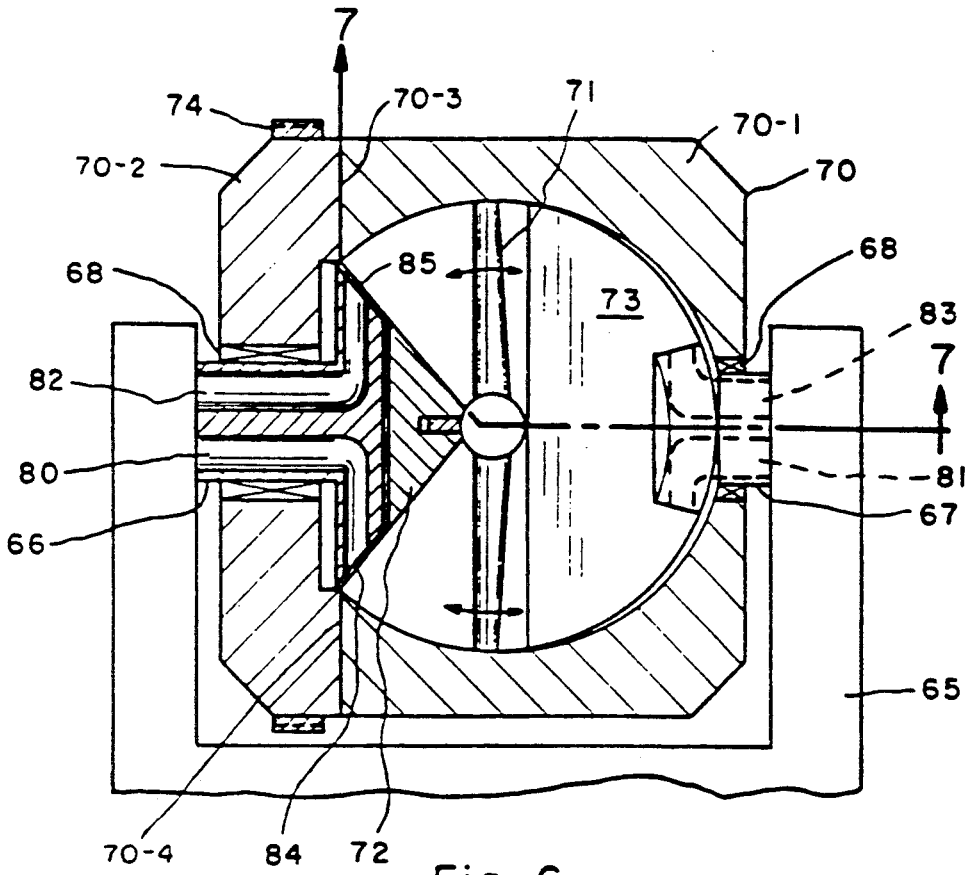
FIG. 6 is a cross-sectional view of a second embodiment in accordance with the invention.
Figure 7:
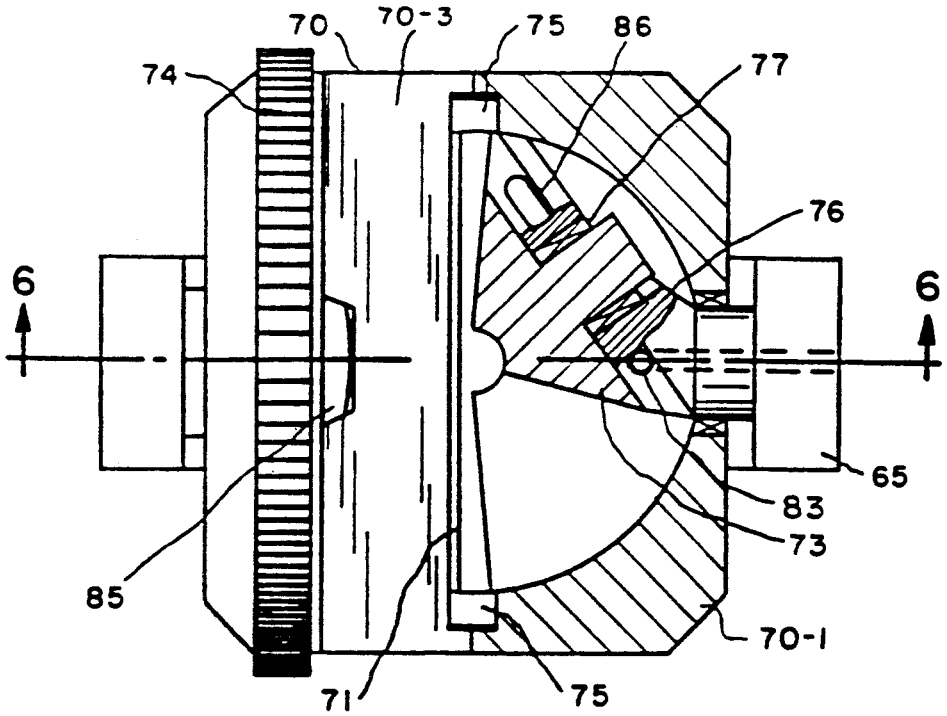
FIG. 7 is a partly cross-sectional, partly elevational view taken along the line 7—7 of the second embodiment of FIG. 6.

FIGS. 6 and 7 illustrate a second embodiment of a pump in accordance with my invention. In this embodiment, a fixed support 65 is provided, from opposite sides of which project inwardly a pair of aligned, opposed, hollow shafts 66, 67. On these hollow shafts is journalled by suitable bearings 68 a housing 70 containing the spherical cavity, and housing as in the first embodiment a disc 71 and a driving 72 and driven wedge 73. The housing 70 can be rotated in any know manner. For instance, a gear 74 can be mounted on the housing periphery for rotation by a conventional electronic motor. Alternatively, the housing can be pulley driven. To obtain rotation of the first wedge 72, the wedge 72 is anchored to the housing walls in any suitable manner.

The wedge 72 thus rotates with the housing 70 about a fixed axis, the shaft 66 axis of rotation, as in the first embodiment. The disc 71 is similar to that of the first embodiment, and the disc pivot connections to the first wedge and second wedge are similar to that of the first embodiment. However, in the second embodiment, the disc 71 is pivotally mounted at its periphery along a diameter to housing walls as shown at 75. Thus, the disc rotates with the housing but also pivots about on axis through its center, as shown by the arrows in FIG. 6. The journalling of the second wedge 73 is also different. Instead of rotating about a fixed axis, the wedge 73 is drivingly connected to an offset arm 76, similar to a crank arm, which is in turn fixed to the other hollow shaft 67. The wedge 73 is journalled 77 on the offset arm 76 for rotation about the wedge axis. Thus, when the rotating driving wedge 72 causes the disc 71 to pivot, the effect is to cause the driven wedge 73 to follow an eccentric motion within the right hand cavity section of FIGS. 6 and 7 quite similar to the motion followed by the wedge in the embodiment of FIG. 3 in my referenced patent.

Because of the rotating housing, the exhaust ports cannot be conveniently located in the housing walls and are thus located within the hollow shafts. Thus, reference 80 designates the exhaust port of the left section of the cavity, and reference 81 designates the exhaust port of the right section of the cavity. It is convenient to locate an intake port 82 for the left cavity section in the hollow shaft 66, in view of the fixed axis of rotation of the driving wedge. However, in the right cavity section, in view of the eccentric motion of the driven wedge, the intake port can if desired be located in the housing wall (not shown) to be covered and uncovered in the proper sequence. This construction is suitable for a compressor, wherein the fluid is a gas such as air. For a liquid fluid, an intake port 83 can also be located in the same hollow shaft 67. As shown, it extends along a groove 86 along the periphery of the offset arm 76. As will be observed, the driving wedge 72, which has a tapered crossection, has solid walls 84 with an opening 85 so that as it rotates the intake and exhaust ports are covered and uncovered in the desired sequence.

What is also different in this embodiment is the way in which the spherical body is constructed. It is constructed in two parts 70-1 and 70-2, sealed together at the boundaries indicated by 70-3, 70-4. This kind of seal, extending as it does over several quadrants of the sphere, is less likely to leak in high-pressure applications.

The pump illustrated in FIGS. 6 and 7 operates similarly to the first embodiment and offers similar advantages.

Both embodiments can be operated with liquid and gaseous fluids.

One of the features of the first embodiment, evident in FIGS. 1-3, is that the journals 36, 40, and the ports 45, 48 are all located in one half of the spherical body. That half 61 can be constructed to be stronger to take the additional loads thus involved, whereas the second half 62 can be constructed as a thin cover member which fits over and seals to the first half 61. This simplifies the sealing of the two halves, and makes it easier to locate more accurately the journals and ports in the heavier body half.

This feature is also shown in the third embodiment illustrated in FIGS. 8-19. As before, a spherical cavity 111 is formed by a body comprising a heavy half 161 to which a lighter half or cover 162 is bolted 163. A single O-ring seal 101 can be used to seal the two halves together. The driving shaft 135 has journals 136 located in a bearing block 102 and sealed by an O-ring 103 to the heavier half 161. To the shaft 135 is attached a first wedge 113 journalled on one side of a disc 112 on whose opposite side is journalled a second wedge 114 also journalled 140 in the heavy half 161 via a shaft 139. Items 104 can be rotary seals for the shaft 135. As in the earlier embodiments, the wedge-disc journals are orthogonal and intersect the sphere center.

Figure 9:
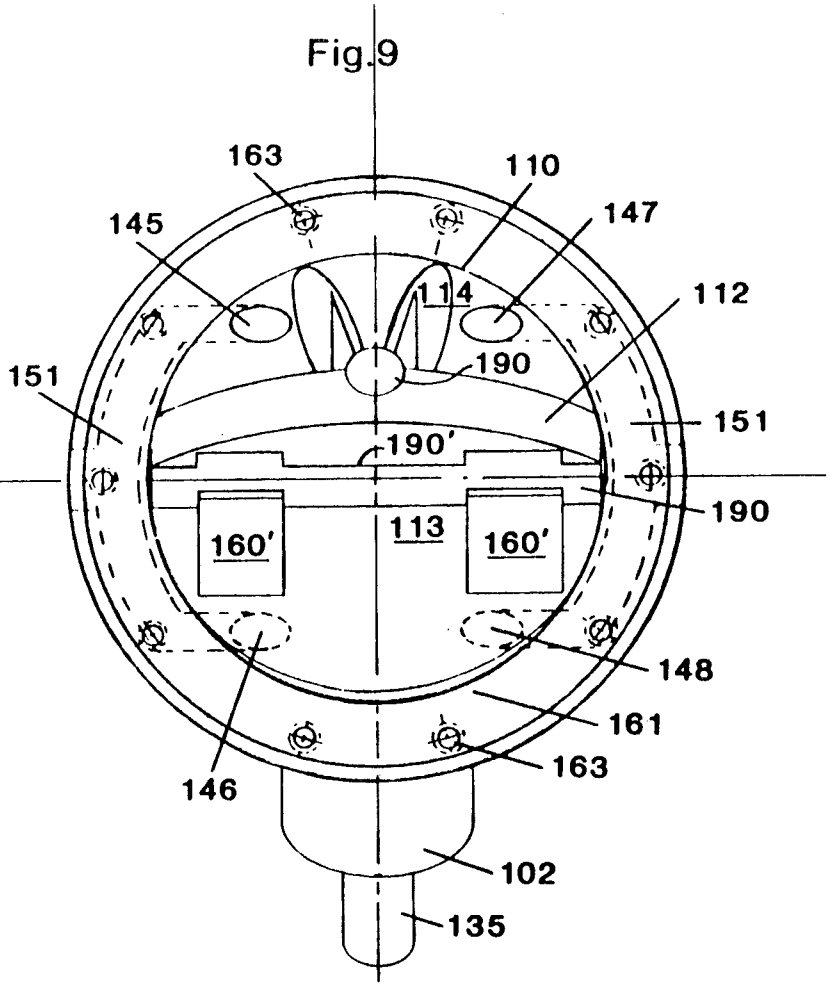
FIG. 9 is a plan view of the device of FIG. 8 with the body cover removed.
Figure 8:
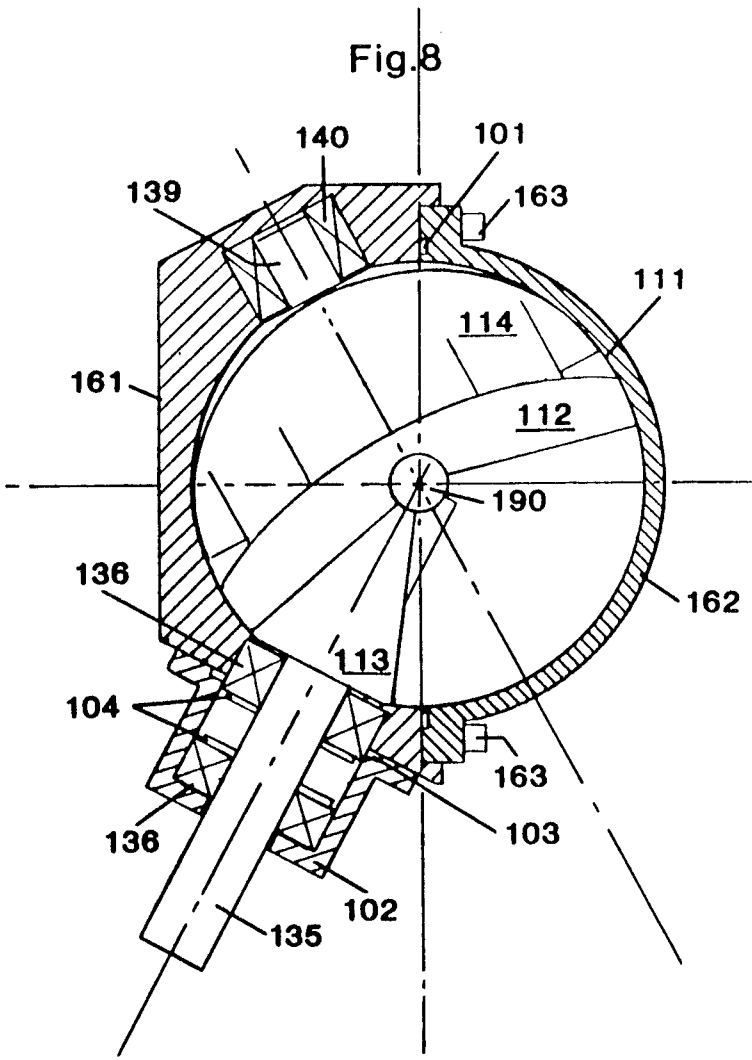
FIG. 8 is a cross-sectional view through the center of a third embodiment in accordance with the invention.
Figures 10, 11, 12, 13:
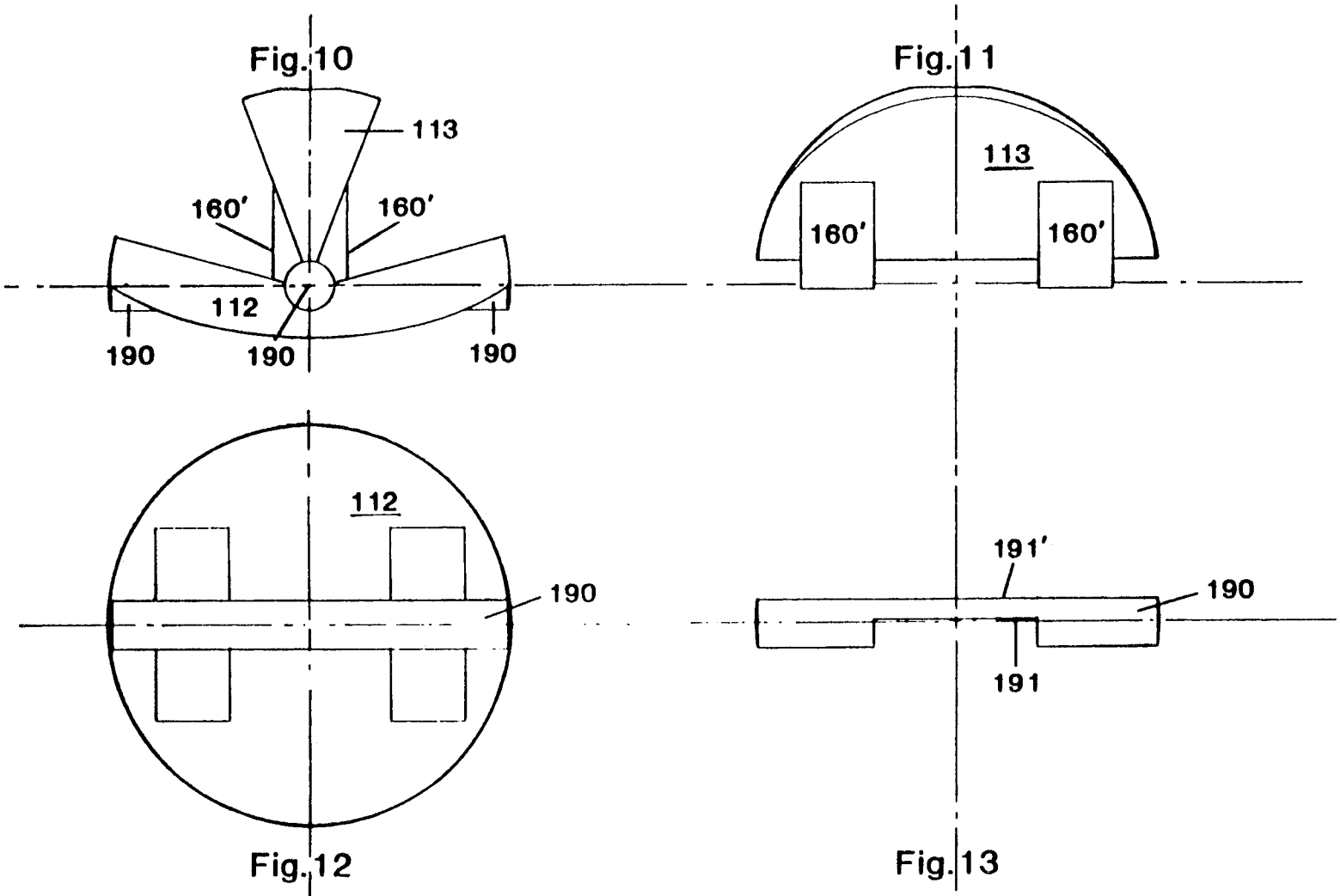
FIG. 10 shows how the disc and wedge fit in the third embodiment.
FIG. 11 is a side view of the wedge of FIG. 10.
FIG. 12 is a plan view of the disc alone of FIG. 10.
FIG. 13 is a side view of the wedge bearing rod of FIG. 12.

FIG. 9 shows the inlet/outlet ports 145, 146 and 147, 148, interconnected by ducts 151.

The disc/wedge bearings are similar to that of the first embodiment, except that separate bearing rods 190 are mounted orthogonally, on opposite disc sides. FIGS. 10-13 also show this feature. The disc 112 is symmetrical, with one side the mirror image of the opposite side except rotated 90°. Here, a bearing rod 190 is mounted, orthogonally relative to the other, on opposite sides at the center of the disc 112, and has a recess 191 fitting over a projecting part 190' (FIG. 9) on the disc. Each wedge 113, 114 has two pairs of projections 160' extending from its straight side. These embrace the bearing rod 190 on its top solid surface 191' opposite the recess 191. The spherical wall prevents the assembly from coming apart. The result is that a straight sealing area is provided between each wedge and the disc along the surface of the rod 190, which, as in the FIGS. 1-4 embodiment, will have less leakage.

Either of the paired ports can serve as inlets or as outlets. A feature is that the inlet ports can readily be aimed toward the sphere center. To the working fluid can be added an oil mist. The oil mist will then hit the center of the bearing rod 190, at its upper surface 191', and centrifugal forces will cause the oil to spread outwardly over the entire bearing rod surface thus providing automatic and continuous lubrication of the disc-wedge pivot bearing. The oil can also act as a sealing medium of the peripheral disc and wedge surfaces where they contact the spherical cavity.

Figures 14, 15, 16:
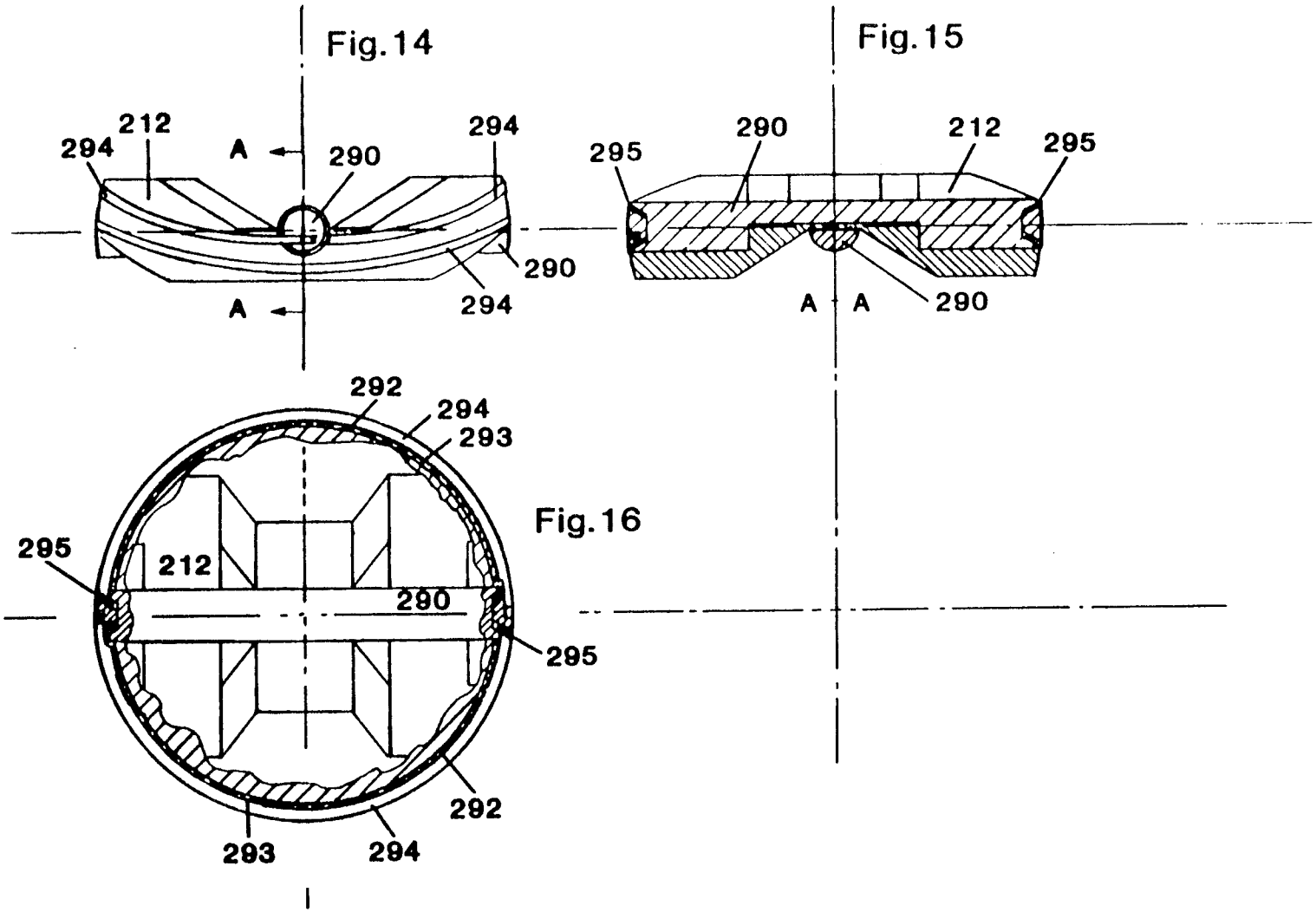
FIG. 14 is a side view of a modified disc of the third embodiment.
FIG. 15 is a cross-sectional view along the line A—A of FIG. 14.
FIG. 16 is a plan view of the disc of FIG. 14.

FIGS. 14-19 show modified disc and wedge constructions providing additional built in seals to reduce or avoid leakage between the different chambers in the device. The outer configuration of the disc 212 is similar to that of the disc 112, and the same bearing rod construction 290 is employed. Along the outer periphery of the disc 212 are provided four annular grooves 292, each extending 180° but circumferentially displaced 90° from each other. In each groove 292 is seated a corrugated metal spring 293 biasing outwardly a seal member 294. Three of the seals 294 are shown in FIG. 14. These seals improve the sealing of the disc 212 to the spherical cavity. The bearing rods 290 are also provided at their ends with special seals in the form of split conical shells 295 whose outer widened end engages the spherical cavity surface.

Figure 17:
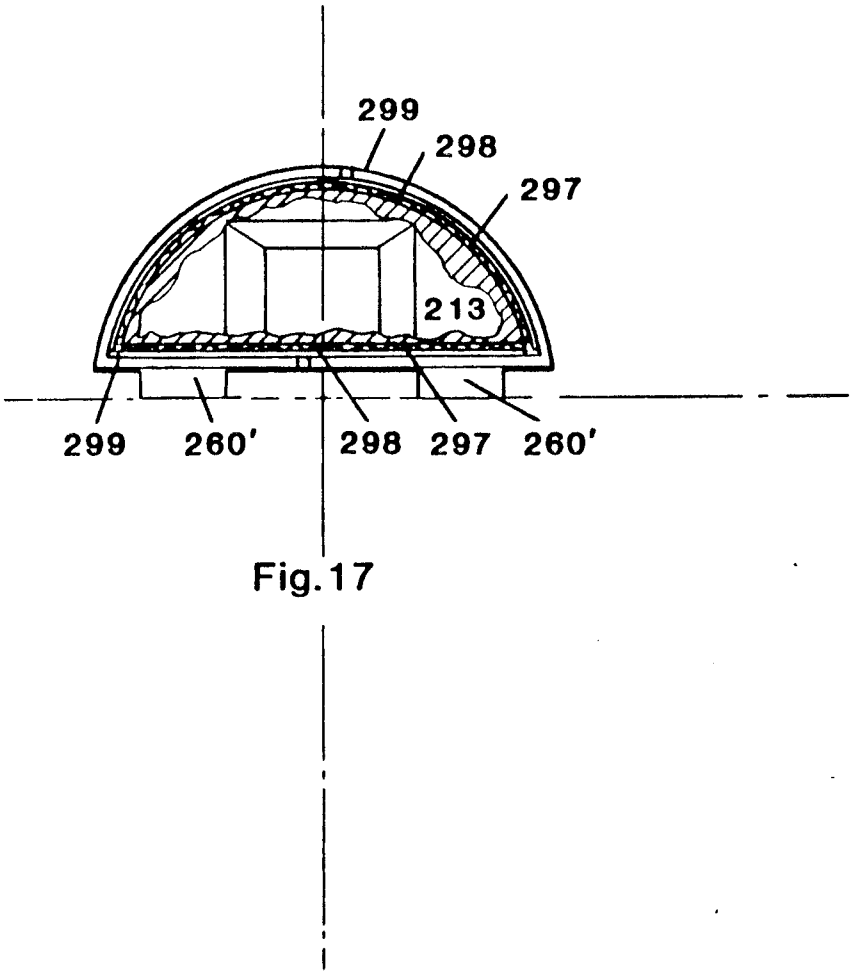
FIGS. 17–19 show, respectively, a plan, side, and top view of a wedge for use in the third embodiment.
Figure 18:
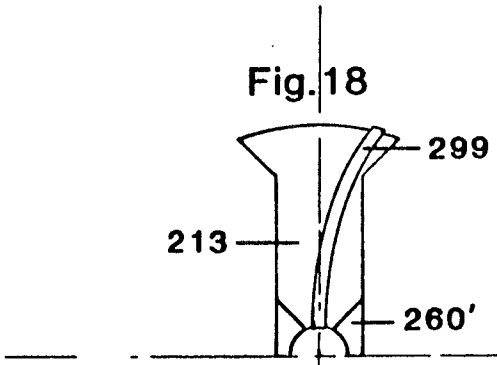
Figure 19:
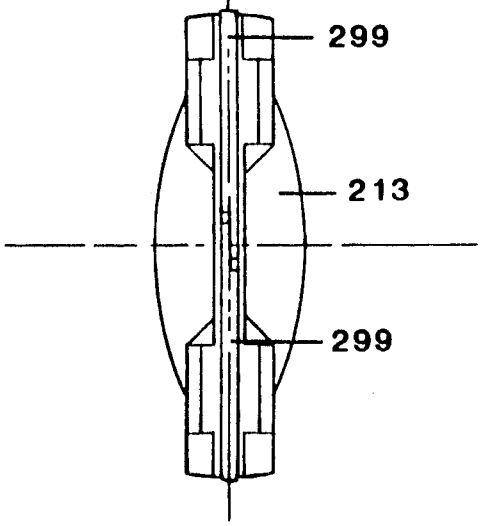

The wedge 213, can be given similar additional sealing, shown in FIGS. 17-19. Grooves 297 in the circular and straight sides house a spring-biased 298 seal member 299 for engaging the spherical cavity wall as well as the surface of the bearing rod 290. These extra seals will prove especially useful to compensate for thermal expansion of the rotating parts.

This third embodiment can be uses as a fluid compressor or pump, or expander, in which latter case it can also function as a motor when high- pressure fluid is inputted , or as a engine when heated fluid is inmputted. Preferably, the parts are made of aluminum for light weight, anodized for hardness at the bearing surfaces. Alternatively, they can be made of suitable plastic nonreactive with the working fluid. The seals can be of conventional material, such as C-seals, Viton, or ferrofluidic seals.

Figure 20:
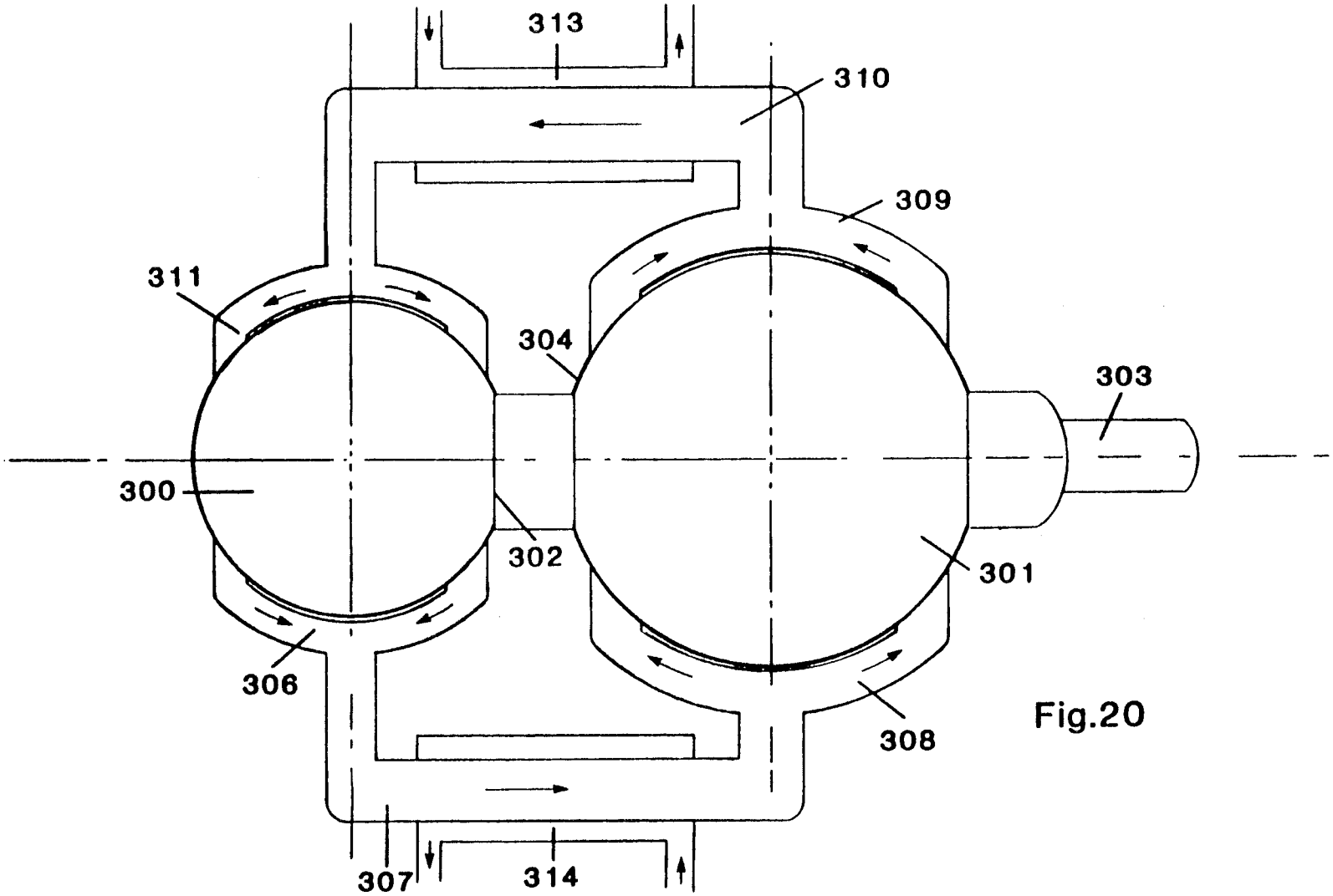
FIG. 20 is a schematic view of two units of the invention coupled together to form a compressor-expander.

FIG. 20 illustrates an application of the invention in a Brayton or gas-turbine cycle. It comprises two positive displacement spherical devices 300, 301 each similar to one of the earlier embodiments. One unit 300 is a compressor with on output shaft 302, and the other is an expander 301 with two output shafts 303, 304. The output ports 306 of the compressor 300 are connected 307 to the input ports 308 of the expander 301. The output ports 309 of the expander 301 are connected 310 to the input ports 311 of the compressor 300. The shafts 302, 304 are coupled together. A heat exchanger 313, 314 is provided between both of the input and output connections as shown. Typically, the expander 301 displacement is chosen larger than that of the compressor 300. The ratio of the volume displaced by the expander 301 to that displaced by the compressor 300 can be selected such that it will operate efficiently at the desired temperature. The working internal pressure of this combination is normally chosen higher than atmospheric pressure. Also, the compressor 300 and expander 301 can be connected in such a way as to cancel out each other's vibrations. This would be accomplished by connecting them such that the movements in one of the two units is opposite to that in the other unit. For example, when the disc in one unit pivots to the left, then the connection would be arranged so that the disc in the other unit is pivoted to the right.

When heat is applied to the heat exchanger 314, the combined device will operate as a heat engine. When rotary power is applied to the output shaft 303, the combined device will operate as a cooler and remove heat from the heat exchanger 314. The components of this combined unit can be designed so that they are molded out of various materials normally not used for engines, such as plastic. Because these units are positive displacement devices, the engine will operate efficiently at variable speeds.

There thus results in accordance with the invention an extremely compact, positive displacement compressor or expander that requires the theoretical minimum envelope size per unit volume of displaced fluid. The device can be used as a compressor, expander, or as an integral expander/compressor. The application areas for this type of device range from compact, long-life aerospace thermal systems to air conditioners and engines for both the home and automobile. It is well-suited for compact heat-activated cooling or power cycles (i.e., Stirling), where it can utilize either solar or low-level waste heat as its prime energy source.

The third embodiment will be also useful as the turbine or compressor of an Escher-Wyss-AK closed-cycle gas turbine system. It can operate with low temperatures, i.e., 100° F., differences. Since it is a positive-displacement device, it will allow efficient operation at both high and low speeds, and thus a substantially constant torque output at different speeds. A further advantage of this cycle is that it allows the use of solid fuel, such as pulverized coal, to heat the working fluid.

While my invention has been described in connection with specific embodiments thereof, those skilled in this art will recognize that various modifications are possible within the principals enunciated herein and thus the present invention is not to be limited to the specific embodiments disclosed.

What is claimed is:

1. A spherical positive displacement device, comprising a fixed housing having a cavity therein shaped to form the major portion of a sphere, a disc having a circular periphery and fitted within the cavity for pivotal movement therein and dividing the cavity into first and second sections, first and second wedge-like members, said first wedge member being pivotally connected at one disc side and lying within the first cavity section, said second wedge member being pivotably connected at the opposite disc side and lying within the second cavity section, fluid inlet and outlet means coupled to the cavity, the pivotal axes of the first and second wedge members being orthogonal to one another and extending in the same plane and intersecting at the sphere center, said housing being divided into two substantially semi-spherical parts, and means for journalling for rotation both the first and second wedge members in the wall of the same housing part.

2. A device as claimed in claim 1, wherein each cavity section has inlet and outlet ports, the location of the ports and the dimensions of the wedge members being such that the inlet and outlet ports are covered and uncovered by their associated wedge to form intake and exhaust ports of a pumping cycle.

3. A device as claimed in claim 2, wherein the inlet and outlets ports are also located in the same housing part containing the journalling means.

4. A device as claimed in claim 3, wherein the housing is fixed, the first wedge is journalled for rotation about a fixed axis, and the second wedge is also journalled for rotation about a fixed axis, the axes of rotation of said first and second wedges forming an angle greater than zero but less that 90°.

5. A device as claimed in claim 4, wherein the inlet and outlet means constitutes ports in the housing wall.

6. A device as claimed in claim 1, further comprising gap sealing between the cavity and the moving parts.

7. A device as claimed in claim 1, wherein said wedges have hook members shaped to engage similarly shaped recessed portions in the disc.

8. A device as claimed in claim 1, wherein the said same housing part is thicker and stronger than the other housing part.

9. A spherical positive-displacement device, comprising a fixed housing having a cavity therein shaped to form the major portion of a sphere, a disc having a circular periphery and fitted within the cavity for pivotal movement therein and dividing the cavity into first and second sections, first and second wedge-like members, said first wedge member being pivotally connected at one side of the disc and lying within the first cavity section, the second wedge member being pivotally connected at the opposite disc side and lying within the second cavity section, fluid inlet and outlet means coupled to the cavity, the pivotal axes of the first and second wedge members being orthogonal to one another and extending in the same plane and intersecting at the sphere center, the pivotal connections of the disc with both wedge members extending over a straight sealing area.

10. A device as claimed in claim 9, wherein each cavity section has inlet and outlet ports, the location of the inlet ports being such that incoming fluid via said port strikes the center of the adjacent sealed area for self-lubrication of the pivotal connections.

11. A device as claimed in claim 9, wherein the pivotal connections of wedge on disc comprises a rod shaped bearing member, each said wedge member having projections embracing said rod-shaped bearing member, and cone-shaped seal means at the ends of the rod-shaped bearing member for sealing the latter to the cavity walls.

12. A device as claimed in claim 11, wherein the said seal means comprise split cone-shaped seals.

13. A device as claimed in claim 9, further comprising seal means mounted along the circular periphery of the disc for sealing the latter to the cavity walls.

14. A device as claimed in claim 9, further comprising seal means mounted along the periphery of both wedge members for sealing the latter to the cavity walls.

15. A device as claimed in claim 9, wherein the housing is constructed in several parts so as to form a low-leakage quadrant seal.

16. A spherical positive displacement device, comprising a housing having a cavity therein shaped to form the major portion of a sphere, a disc having a circular periphery and fitted within the cavity for pivotal movement therein and dividing the cavity into first and second sections, first and second wedge-like members, said first wedge member being pivotally connected at one disc side and lying within the first cavity section, said second wedge member being pivotably connected at the opposite disc side and lying within the second cavity section, fluid inlet and outlet means coupled to the cavity, the pivotal axes of the first and second wedge members being orthogonal to one another and extending in the same plane and intersecting at the sphere center, said housing being divided into two substantially semi-spherical parts, means for journalling for rotation both the first and second wedge members in the same housing part, the first wedge being anchored to the housing, the housing being mounted on hollow shafts, means for rotating the entire housing about the hollow shafts as an axis, the disc being pivotally mounted at the cavity walls.

17. A device as claimed in claim 16, wherein the first wedge has an axis of rotation coincident with that of the housing, said second wedge being offset mounted with respect to the housing shafts whereby displacement of the disc effects eccentric movement of the wedge relative to the housing shaft.

18. A device as claimed in claim 17, wherein the inlet and outlet means comprises ports in the hollow shafts.

* * * * *